United States Patent [19]

Meyer

[11] Patent Number: 4,501,214

[45] Date of Patent: Feb. 26, 1985

[54] MAST FOR A SAIL

[76] Inventor: Urs P. Meyer, In der Rehweid 2, CH-8122 Pfaffhausen, Switzerland

[21] Appl. No.: 494,925

[22] Filed: May 16, 1983

[30] Foreign Application Priority Data

May 18, 1982 [CH] Switzerland ..... 3079/82

[51] Int. Cl.[3] ..... B63H 9/04

[52] U.S. Cl. ..... 114/39; 114/90

[58] Field of Search ..... 114/39, 89–103; 441/74

[56] References Cited

U.S. PATENT DOCUMENTS

| | | | |
|---|---|---|---|
| 601,494 | 3/1898 | Clapham | 114/90 |
| 2,162,441 | 6/1939 | Mead | 114/39 |
| 2,544,081 | 3/1951 | Hallen | 114/90 |
| 3,310,017 | 3/1967 | Dyer | 114/102 |
| 3,487,800 | 1/1970 | Schweitzer et al. | 114/91 |
| 3,765,360 | 10/1973 | Monfort | 114/90 |
| 3,882,810 | 5/1975 | Roeser | 114/90 |
| 3,948,199 | 4/1976 | Lamboley | 114/90 |

FOREIGN PATENT DOCUMENTS

| | | | |
|---|---|---|---|
| 30495 | 6/1981 | European Pat. Off. | 114/39 |
| 2492764 | 4/1982 | France | 114/90 |

*Primary Examiner*—Trygve M. Blix
*Assistant Examiner*—Stephen P. Avila
*Attorney, Agent, or Firm*—Watson, Cole, Grindle & Watson

[57] ABSTRACT

Mast (1) having essentially a rectangular cross-section with rounded narrow sides, preferably made in sandwich-type construction from integrally fiberglass-reinforced polyurethane structural foam (7) as core material with fiberglass laminates (8) as stressed skins bonded to both wide sides. The depth measured between the two narrow sides is greatest in the vicinity of the attachment area of the wishbone-type boom (12), and it decreases from there towards at least the top end, whereby the average depth of the mast cross-section shall measure at least twice as much as the mast width. The mast (1) for a sail-board is connected with the wishbone-type boom (12) via an articulated attachment (13) thus permitting the mast to pivot freely within the limits of the wishbone boom and to point its narrow leading edge against the wind. The mast (1) is essentially submitted only to a stress resulting from the tractional force of the sail (14) attached behind the narrow backside of the mast. The mast (1) possesses a much higher breaking strength and stiffness edgeways than conventional round tubular masts. Furthermore, the narrow flat mast (1) has a drastically reduced frontal area and is therefore aerodynamically much more efficient as well as lighter in weight than a conventional round mast.

16 Claims, 12 Drawing Figures

MAST FOR A SAIL

BACKGROUND OF THE INVENTION

The present invention relates to a mast for a sail, more specifically for the sail of a sail-craft rigged with only one "cat"-type main-sail, but having no foresail, such as sail-boards or small yawls.

The most simple and common masts of this type have a round or roundish cross-section, often tapering towards the top end. In many cases, the non-braced masts of these small sail-craft are of hollow, tubular shape and made from fiberglass-reinforced resin. It must be noted that the chosen diameter for theses masts always represents a compromise. On one hand, a stiff mast, calling for a large diameter cross-section, is desirable, because it will not deflect much under high wind-pressure acting upon the sail, thus preserving an efficient sail curvature for maximum thrust. On the other hand, a slim mast with a small diameter would cause much less aerodynamic drag and turbulence. Such turbulence and drag can be especially harmful in the forward section of the sail, where an unimpeded airflow will provide most of the forward thrust. By using aluminum alloy instead of fiberglass, the stiffness will increase, however, at the same time the breaking strength will drastically diminish. By making masts instead from carbon-fibre-reinforced resin, Kevlar or other exotic materials, fairly slim masts with adequate breaking strength can be made. However, their price will be extremely high.

In order to try to improve the aerodynamic shape of theses masts, somewhat streamlined cross-sections, either oval or tear-shaped, have been manufactured, especially for masts being held in place and being supported by stays and guys, which will absorb practically all forces taking effect upon the mast. Thus, it is possible to employ much slimmer mast profiles than would be the case with non-braced masts.

When masts with tear-drop-shaped cross-sections are mounted firmly without means for turning around their own axis in order to point in the same direction as the sail, their frontal area exposed to the wind may even be larger than with simple round masts. Tear-drop-shaped masts only represent an improvement if they are allowed to turn in the same direction as the sail. Such articulated, tear-drop-shaped masts are being used on high-performance sail-crafts, such as catamarans, land-sailers and ice-boats or, in other words, where the resulting advantages will be most noticeable due to the potentially high speeds of these crafts.

Light sail-craft and sail-boards most often are equipped with free standing masts without guys or stays. These masts are usually hollow for weight reasons, and their cross-sections are either mostly round or have a a length-to-width ratio of approximately 1:1. Therefore, these masts have approximately the same flexibility and strength in all directions.

Airflow has a similar effect on a sail-system as on rigid air-foils. In both cases, the resulting force is called "lift". It is the result of the air flowing over and under the air-foil or sail, thereby changing the direction somewhat. It is desirable to convert a given air-flow into as much lift as possible, and this can only be achieved by sustaining the least possible air resistance. Lift is a force working usually at about a right angle to the sail or air-foil. However, whereas in a rigid wing, this force is trying to bend the center beam of the wing structure at a right angle to the wing surface, the sail mast will bend parallel with the sail or, in other words, approximately in the direction the wind is blowing. There is practically no loss of lift when a rigid wing bends under load. However, when a strong wind blows into a sail, it bulges and pulls the mast backwards, thereby causing the deepest point of the sail curvature to move backwards where it increases drag. Judging from the way masts are shaped, reinforced and braced, it must be concluded that it is common belief that normally masts are submitted to forces parallel to the lifting force. However, this is truly not the case in the case of masts without a foresail. This invention is based on the assumption that the tension of the sail is the main force to which the mast is submitted when under sail, and this force acts in the direction the sail is pointing immediately behind the mast.

SUMMARY OF THE INVENTION

The objective of this invention is to provide a free sail mast without guys or stays having a high degree of stiffness and breaking strength while creating as little aerodynamic drag and turbulence as possible.

It is preferable that the mast of a sail-board has the largest cross-section in the vicinity of the boom attachment and that it gradually diminishes at least towards the top end. It is also desirable to attach the mast with the boom in such a way that the mast is allowed to pivot freely within the forward inside space of the wishbone boom in such a way that it can point correctly into the wind.

In regards to the features of the inventive mast described under claim 1 having the sail include a pulling force in line with the longer axis of the mast cross-section, thus submitting it to a bending stress, an obvious prejudice concerning the previously assumed stress mode has been overcome.

Further details and advantages are the result of the following description and drawings which show examples of executions of the invention.

DESCRIPTION OF THE DRAWINGS

FIG. 1 illustrates a mast for a sail-board as seen from head-on;

FIG. 2 the mast according to FIG. 1 as seen from the side;

FIG. 3 illustrates on an enlarged scale, a cross section through the inventive mast as seen along line 3—3 of FIG. 2;

FIG. 4 illustrates on an enlarged scale, a cross section through the inventive mast as seen along line 4—4 of FIG. 2;

FIG. 5 illustrates on an enlarged scale, a cross section through the inventive mast as seen along line 5—5 of FIG. 2;

FIGS. 6 and 8 show side and front views of a sail-board which utilizes a conventional, round tubular mast, the mast being bent as the result of wind blowing from the port side;

FIGS. 7 and 9 show similar side and front views of a sail-board which utilizes a mast as shown in FIGS. 1 and 2;

FIG. 10 illustrates the flow of air around the mast as shown in FIGS. 1 and 2 when oriented to have a slightly negative attack against the wind;

FIG. 10*a* illustrates the flow of air around a conventional round tubular mast when oriented to have a slightly negative attack against the wind;

FIG. 11 illustrates an embodiment of articulated attachments between a wishbone boom of a sail-board and the inventive mast as shown in FIGS. 1 and 2.

DETAILED DESCRIPTION OF THE PREFERRED EMBODIMENT

Figures 1, 2, 3, 4, 5, 6, 7, 8, 9, 10, 10A, 11:
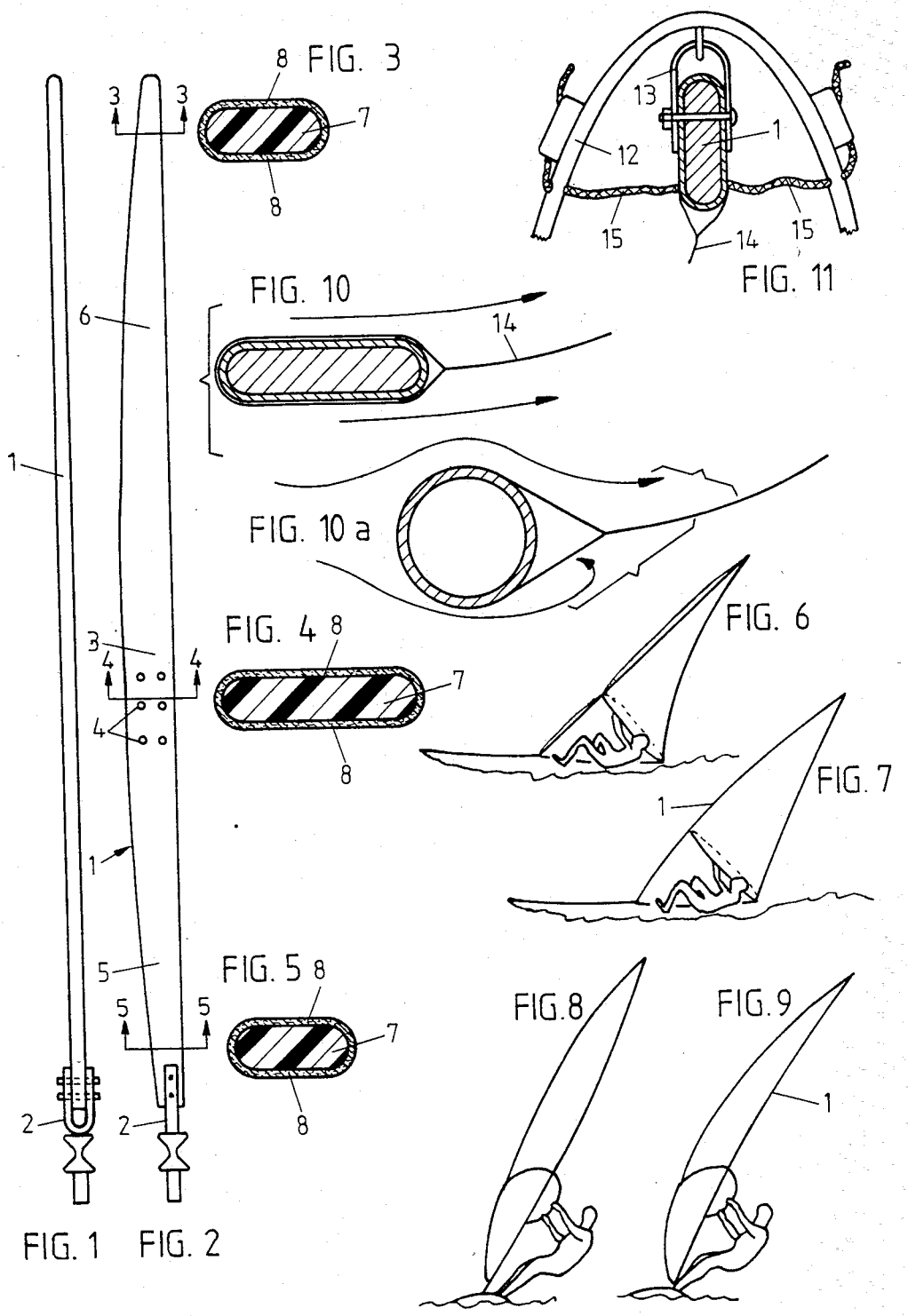

The mast 1 in FIGS. 1 and 2 is for a sailboard, and it is equipped at its lower end with an articulated mast foot 2, thus permitting the mast to be turned and pivoted freely. FIG. 1 illustrates a mast having a constant width over the entire length. This feature simplifies its manfacturing process. However, masts with variable width are feasible, too.

The cross section of the mast illustrated under FIG. 2 is variable, but only the depth of the mast profile changes. At about one third of the mast height from the bottom is the section 3 with the largest profile depth, because this is where the wishbone-type boom, which is not shown, is connected. As a result, this is where the highest stresses occur. In this section 3 the mast is provided with several attachment holes 4 for mounting the wishbone boom as the desired height. Below, the mast tapering gradually towards a smaller cross-section 5. But here, it is only the depth of the mast profile which changes. At the same time, the upper section 6 of the mast becomes narrower towards the top. The cross-sections of the mast 1 in sections 3, 5 and 6 are illustrated, on an enlarged scale, in FIGS. 3–5. The cross sectional depth of the mast 1, averaged over its length, will preferably be at least two times greater than its cross sectional width, and most preferably, at least 2.5 times greater. The length of the shorter axes averaged over the length of the mast is preferably no more than 0.7% of the length (height) of the mast.

One tested version of such a mast measures 4.5 m in height, and it has a constant width of 22 mm over its entire length. The depth of the mast profile just above the mast foot 2 is 40 mm, in the section where the boom 3 is attached the depth is 80 mm, and at the mast top it measures 35 mm. Preferably, the mast consists of a compound sandwich-type construction with a structural polyurethane foam core with integral fibreglass-reinforcement, both sides of which are bonded to stressed skins made from unidirectionally reinforced fiber-glass. The weight of this mast is approximately 2.3 kp. In comparison to a conventional round tubular mast, the above-described mast has these following advantages: the frontal area is reduced by as much as 0.10 m2 or, in other words, by approximately 50%, the mast is about 10% lighter in weight, and at the same time it is about 3 times as stiff in its main stress direction and, furthermore, it is much more resistant to breakage.

The flat mast is aerodynamically substantially more efficient, and due to the fact that it contains no cavities, it will never sink. Flat masts can be manufactured economically by first laminating large sandwich boards from the above-mentioned materials. From these, the masts can be cut by sawing off slices. The wider the slice, the stiffer the mast will be. Thus, it is possible to exactly determine the characteristics of flexibility by the dimension and the shape of the cut. From the same basic sandwich-type board, stiff or flexible flat masts can be cut off. These mast strips should be finished by rounding the edges and by covering the narrow sides with a protective material, such as fiberglass or a thermoplastic profile.

According to FIGS. 3 to 5 stressed skins of fiberglass laminate 8 are bonded to both sides of the polyurethane hard foam core 7.

Naturally, the cross-section of a flat mast could be of flat oval shape, too. Another manufacturing possibility for such masts would be to wet-wrap a pre-fabricated structural foam core with fiberglass, graphite or Kevlar fibres and resin, place it in a mold and cure it under heat and pressure.

This mast with a structural foam core has the added advantages that any kind of attachment can be accomplished by drilling and screwing. No attention must be paid to sealing of holes for reasons of floatation, as is the case with hollow tube masts.

The behaviour of the flat mast with attached sail under the influence of wind is illustrated in FIGS. 7 and 9, where the mast is seen both from the front and from the side. As a comparison, the same views of a round tubular mast with sail under influence of wind are shown in FIGS. 6 and 8. It becomes clearly visible that the reaction between these masts is quite different.

The round tubular mast bends in such a way that its top moves towards the lee side, which is not desired, because it lets the wind spill out over the sail top. However, the flat mast reacts in such a way that its mast top moves towards the luff side all by itself under the same influence of wind. The resulting concave shape of the mast/sail-assembly towards luff is very ideal, because the wind is forced to flow through the sail without spillage, and this increases lift.

Under the influence of the tractional forces of a normally cut sail upon the mast, the latter can turn in such a way that a small angle is formed between the longitudinal axis of its cross-section and the sail immediately behind the mast. This results in a greater stable curvature over the leading edge portion of the sail comparable to the extended nose-flap of an airplane wing, which is well-known for increasing lift substantially.

FIG. 11 illustrates that the flat mast 1 of a said-boards is connected with the wishbone-type boom 12 via an articulated attachment 13 in such a way that the mast can pivot freely around the attachment 13 within the confines of the boom 12, thereby permitting it to always expose its narrow side against the wind. FIG. 11 also shows that the sail 14 forms an approximately straight continuation of the longer axis of the cross-section of the mast. By means of ropes 15 attached to both sides of mast 1, it is possible to adjust the angle of attack of the mast for the purpose of affecting the said trim.

Finally, the mast described therein will also improve sailing characteristics by offering the possibility to alter the profile depth of the sail according to the prevailing wind conditions. This is accomplished by having a different curvature along one edge of the mast than on the other. One small side of the mast may be straight, providing the sail with deeper curvature, and the other side may have a convex curve resulting in a flatter sail profile shape. By simply turning the mast by 180° within the mast pocket of the sail, the profile shape of the sail can be quickly adapted to the prevailing wind conditions and to suit personal taste.

What is claimed is:

1. A mast for use on a sailcraft, said mast being swivel-mountable at its lower end to the sailcraft so as to be rotatable with respect thereto yet utilizing no bracing attachments anywhere along its length to the sailcraft, said mast having an elongated cross section at every point along its length, thus providing said mast with a narrow front surface, a narrow rear surface and wide opposite side surfaces, the dimensions of the cross sections of said mast changing along its length, each cross section including a longer axis which extends between the narrow front and rear surfaces of said mast and a shorter axis which extends between the wide opposite side surfaces of said mast, the length of the longer axes of the cross sections, when averaged over the lenght of the mast, being at least 2.5 times greater than the length of the shorter axes, such that said mast has a higher flexibility in the direction of said shorter axes than along the direction of its longer axes, said mast being capable of deflecting under the influence of the force applied thereto by an attached sail, itself acted on by a flow of air, said mast being capable of bending to become concave towards the luff side and rotating about its lower end and into the flow of air, based on the sail-applied force.

2. A mast as defined in claim 1, wherein the wide opposite side surfaces of said mast are flat and extend in parallel along the length of said mast.

3. A mast as defined in claim 1, wherein said narrow front surface and said narrow rear surface, when viewed in cross section, provide convex front and rear surfaces to said mast.

4. A mast as defined in claim 1, wherein said narrow front surface is straight along the length of said mast.

5. A mast as defined in claim 1, wherein said narrow rear surface is convex shaped along the length of the mast.

6. A mast as defined in claim 1, wherein the mast has a compound construction.

7. A mast as defined in claim 6, wherein the mast includes a core made of integrally fiberglass-reinforced polyurethane structural foam and a bonded external covering of high tensile-strength, fiber-reinforced resin stressed skin.

8. A mast as defined in claim 1, wherein the mast has a cross section of greatest dimensions at a point about one third along its length above its lower end, the cross sectional dimensions of said mast decreasing thereabove in the direction of the upper end of said mast.

9. A mast as defined in claim 8, wherein the mast includes means thereon near said cross section of greatest dimensions for attachment of a wishbone-type boom thereto.

10. A mast as defined in claim 9, wherein the attachment means includes a generally U-shaped yoke extending forwardly of its narrow front surface to which an eye hook on the wishbone-type boom can be freely movably mounted.

11. A mast as defined in claim 8, wherein the cross sectional dimensions of said mast decrease below said cross section of greatest dimensions in the direction of the lower end of said mast.

12. A mast as defined in claim 1, wherein said mast includes an articulated mast foot attached to its lower end, thus enabling said mast to rotate with respect to the sailcraft on which it is mounted and take a negative angle of attack in relation to the air flow acting on the mast and sail attached thereto.

13. A mast as defined in claim 1, wherein the length of the shorter axes of said mast cross sections, averaged over the length of said mast, is no more than 0.7% of the length of said mast.

14. A mast as defined in claim 1, including a sail attached thereto which extends behind its narrow rear surface.

15. A sailcraft which comprises a main body, a mast mounted thereon, and a sail attached to said mast, said mast being swivel mounted at its lower end to the sailcraft so as to be rotatable with respect thereto yet utilizing no bracing attachments anywhere along its length to the sailcraft, said mast having an elongated cross section at every point along its length, thus providing said mast with a narrow front surface, a narrow rear surface and wide opposite side surfaces, the dimensions of the cross section of said mast changing along its length, each cross section including a longer axis which extends between the narrow front and rear surfaces of said mast and a shorter axis which extends between the wide opposite side surfaces of said mast, the length of the longer axes of the cross sections, when averaged over the length of the mast, being at least 2.5 times greater than the length of the shorter axes, such that said mast has a higher flexibility in the direction of said shorter axes than along the direction of its longer axes, said mast deflecting under the influence of the force applied thereto by said attached sail when acted on by a flow of air, said mast being capable of bending to become concave towards the luff side and rotating about its lower end into the flow of air, based on the sail-applied force.

16. A sailcraft as defined in claim 15, wherein said body comprises a sail-board.

* * * * *